US008484870B1

(12) United States Patent
Burns

(10) Patent No.: US 8,484,870 B1
(45) Date of Patent: Jul. 16, 2013

(54) APPARATUS AND METHOD TO DISPLAY CONTENT IN A TRANSPARENT VESSEL

(76) Inventor: Debra L. Burns, New Smyrna Beach, FL (US)

( * ) Notice: Subject to any disclaimer, the term of this patent is extended or adjusted under 35 U.S.C. 154(b) by 240 days.

(21) Appl. No.: 12/806,978

(22) Filed: Aug. 25, 2010

(51) Int. Cl.
*G09F 3/00* (2006.01)

(52) U.S. Cl.
USPC ..... 40/310

(58) Field of Classification Search
USPC ..... 40/306, 310, 311, 324; 206/540
See application file for complete search history.

(56) References Cited

U.S. PATENT DOCUMENTS

| | | | | |
|---|---|---|---|---|
| 588,216 | A | 8/1897 | Bourke | |
| 813,764 | A | 2/1906 | Bailey | |
| 1,014,486 | A * | 1/1912 | King | 40/310 |
| 1,577,374 | A * | 3/1926 | Shelley | 215/6 |
| 1,601,018 | A | 9/1926 | Haynes | |
| 1,617,850 | A | 2/1927 | Kelly | |
| 1,708,567 | A | 4/1929 | Corcoran | |
| 1,725,199 | A | 8/1929 | Kuhn et al. | |
| 1,824,229 | A | 9/1931 | Pevsner | |
| 1,878,541 | A * | 9/1932 | Reinhold | 40/311 |
| 1,994,961 | A * | 3/1935 | Proskauer | 40/311 |
| 2,305,890 | A | 12/1942 | Moore | |
| 3,374,911 | A | 3/1968 | White | |
| 4,979,325 | A | 12/1990 | White | |
| 5,758,440 | A | 6/1998 | Yudin | |
| 5,937,554 | A | 8/1999 | Haugk et al. | |
| 6,073,373 | A | 6/2000 | Haugk et al. | |
| 6,233,856 | B1 | 5/2001 | Haugk et al. | |
| 6,272,777 | B1 | 8/2001 | Swenson | |
| 6,378,906 | B1 | 4/2002 | Pennaz | |
| 6,725,589 | B2 | 4/2004 | Braun | |
| 6,725,591 | B2 | 4/2004 | McLaughlin, Jr. | |
| 7,367,145 | B2 | 5/2008 | Mou | |
| 2004/0007557 | A1 * | 1/2004 | Maliszewski et al. | 215/365 |

* cited by examiner

*Primary Examiner* — Joanne Silbermann
(74) *Attorney, Agent, or Firm* — Allen, Dyer, Doppelt, Milbrath & Gilchrist P.A.

(57) ABSTRACT

An apparatus and method to display content in a transparent vessel. The transparent vessel has a transparent vessel wall, transparent vessel floor, and transparent vessel mouth. Content having a content display surface is rolled up and inserted through the transparent vessel mouth, unrolled inside the transparent vessel, and held flat against a transparent vessel wall inside surface, optionally with the aid of a prod having a non-slip prod tip attached to a rigid prod shaft. Stabilization media such as glass beads or seashells is poured into the transparent vessel and serves to hold the content in a desired display position inside the transparent vessel.

6 Claims, 6 Drawing Sheets

Fig. 4
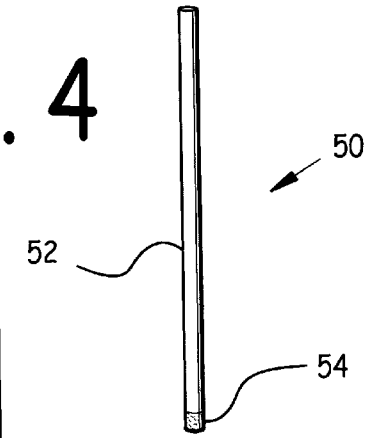
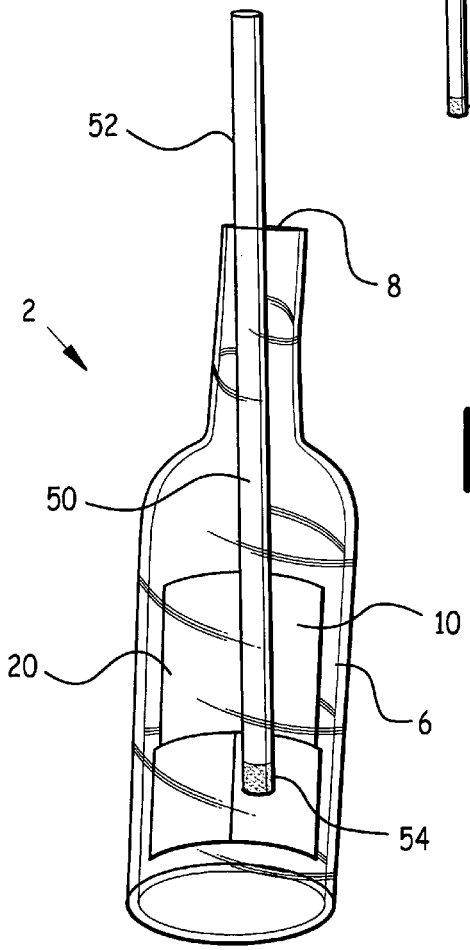
Fig. 5

APPARATUS AND METHOD TO DISPLAY CONTENT IN A TRANSPARENT VESSEL

BACKGROUND OF THE INVENTION

1. Field of the Invention

This invention relates to display devices, and in particular to an apparatus and method to display content in a transparent vessel.

2. Background of the Invention

Transparent vessels such as bottles have long been used to display a wide variety of items: model ships, different-colored sand, etc.

It would be desirable to provide to an apparatus and method to display content in a transparent vessel, however, wherein content such as text and pictures may be quickly and easily inserted and immobilized in a transparent vessel, and nearly as easily exchanged for different content.

Existing Designs

A number of approaches have been proposed to provide a bottle for pictorial and textual content display. U.S. Pat. No. 6,378,906 was granted Pennaz for a label inserted in a bottle wall. While this design provided content visible from outside the bottle, the content had to be inserted into the wall of the bottle during the manufacturing process, and could not be changed thereafter without breaking the bottle.

A number of patents have been granted for labels immersed in clear liquid inside bottles, some requiring grooves, projections, or other content-stabilizing means. Representative of this "clear liquid" class of inventions are U.S. Pat. Nos. 6,233,856, 6,073,373 and 5,937,554 granted to Haugk et al.; 6,725,589 to Braun; 6,272,777 to Swenson; and 5,758,440 to Yudin. These designs suffered from the disadvantage of requiring a transparent liquid in the bottle to be able to see the content (as opposed to an opaque liquid), and in some cases (notably the Haugk patents), some species of grooves, projections, etc., which increase manufacturing cost and complexity.

Another class of content-display bottles involve two nesting containers, the outer container being transparent, and the content sandwiched between the two nesting containers. Exemplary of this type of container are U.S. Pat. Nos. 4,979,325 and 3,374,911 granted White. The requirement of duplicative containers raised the manufacturing cost and complexity in these devices.

Still another approach was taught in the Kuhn et al. U.S. Pat. No. 1,725,199, which relied on the application of decals to an inside bottle surface. These could be problematic to later remove and replace with different content, and this design suffered from the drawback of having to convert any content desired to be displayed into decals before being able to install the content in the bottle. This requirement raises the cost, complexity, and difficulty of content emplacement in a bottle in accordance with the Kuhn '199 method.

SUMMARY OF THE INVENTION

Accordingly, it is an object of the present invention to provide an apparatus to display content in a transparent vessel which permits quick and easy initial emplacement of content against a transparent vessel wall inside surface, and fast and easy replacement of same with different content, as desired. Design features allowing this object to be accomplished include a transparent vessel having a transparent vessel wall, content having a content display surface sufficiently flexible to be rolled up into a roll which can slide through a transparent vessel mouth into a transparent vessel cavity, and stabilization media which presses the content against the transparent vessel wall inside surface. Advantages associated with the accomplishment of this object include the ability to quickly display desired content, and to easily replace same with new content, as desired.

It is another object of the present invention to provide an apparatus to display content in a transparent vessel with a variety of indicia display features. Design features allowing this object to be accomplished include a closure with closure indicia, amulet with amulet indicia depending from an emulate chain, and a ribbon. Benefits associated with the accomplishment of this object include greater content display flexibility, and quick modification of the outward appearance of the apparatus and method to display content in a transparent vessel.

It is still another object of the present invention to provide a method to display content in a transparent vessel which permits quick and easy initial emplacement of content against a transparent vessel wall inside surface, and fast and easy replacement of same with different content, as desired. Method steps allowing this object to be accomplished include providing a transparent vessel having a transparent vessel wall, providing content having a content display surface sufficiently flexible to be rolled up into a roll which can slide through a transparent vessel mouth into a transparent vessel cavity, providing stabilization media which presses the content against the transparent vessel wall inside surface, rolling up and inserting the content into the transparent vessel into a desired location, holding the content in the desired location within the transparent vessel, and inserting sufficient stabilizing media into the transparent vessel to immobilize the content flat against the transparent vessel wall inside surface in the desired location. Advantages associated with the accomplishment of this object is the ability to quickly display desired content, and to easily replace same with new content, as desired.

It is yet another object of this invention to provide an apparatus and method to display content in a transparent vessel which is inexpensive. Design features allowing this object to be achieved include the use of components made of readily available materials. Benefits associated with reaching this objective include reduced cost, and hence increased availability.

BRIEF DESCRIPTION OF THE DRAWINGS

The invention, together with the other objects, features, aspects and advantages thereof will be more clearly understood from the following in conjunction with the accompanying drawings.

Six sheets of drawings are provided. Sheet one contains FIG. 1. Sheet two contains FIG. 2. Sheet three contains FIG. 3. Sheet four contains FIGS. 4 and 5. Sheet five contains FIG. 6. Sheet six contains FIG. 7.

FIG. 4 is a front isometric view of a prod.

FIG. 5 is a front isometric view of a prod being used to hold unrolled content in place against a wall inside surface of a transparent vessel.

DETAILED DESCRIPTION OF THE PREFERRED EMBODIMENT

Figure 1:
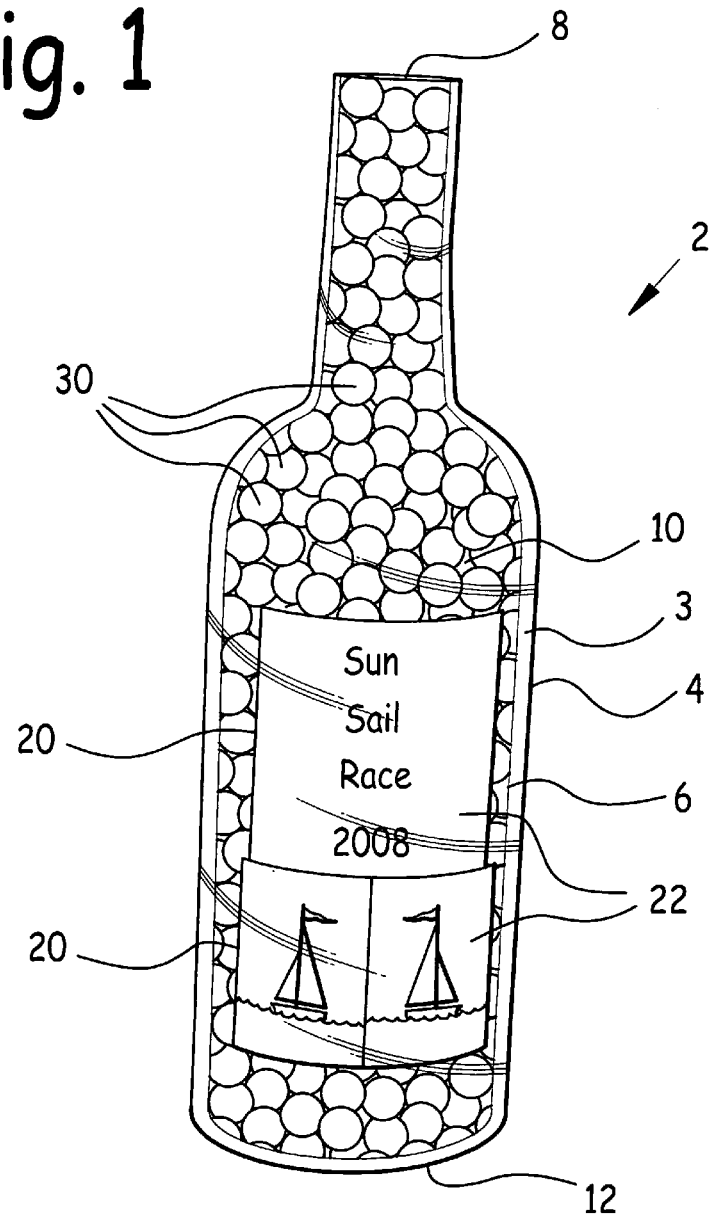
FIG. 1 is a front isometric view of content being displayed in a transparent vessel in accordance with the instant method.
Figure 2:
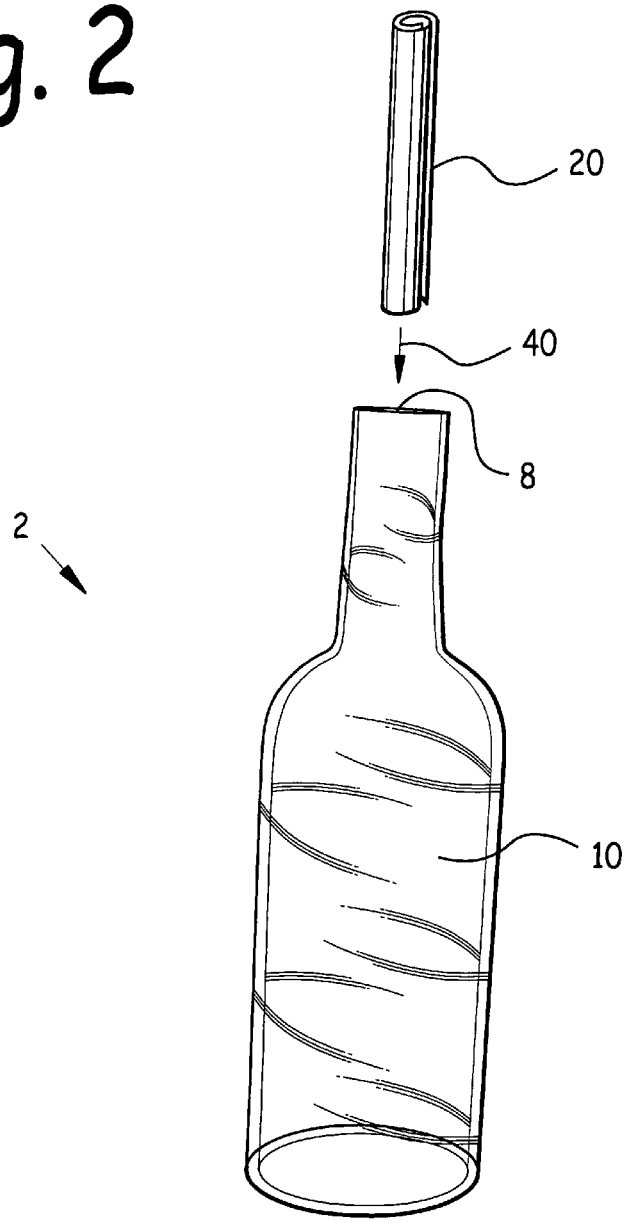
FIG. 2 is a front isometric view of a transparent vessel depicting rolled-up content being inserted into the transparent vessel.

FIG. 1 is a front isometric view of content 20 being displayed in transparent vessel 2 in accordance with the instant method. FIG. 2 is a front isometric view of transparent vessel 2 and depicts rolled-up content 20 being inserted into transparent vessel 2.

Transparent vessel 2 comprises transparent vessel wall 3 attached along its lower edge to transparent vessel floor 12. Transparent vessel wall 3 and transparent vessel floor 12 define and surround transparent vessel cavity 10. In the preferred embodiment, transparent vessel wall 3 was transparent. In the preferred embodiment, transparent vessel floor 12 was substantially planar (or flat), so that transparent vessel 2 is disposed substantially vertical when resting on transparent vessel floor 12.

Although the cross-sectional shape of the transparent vessel 2 depicted in the drawings is circular, it is intended to fall within the scope of this disclosure that the cross-sectional shape of transparent vessel 2 be any appropriate shape, including but not limited to ovoid, irregular, triangular, square or other polygonal shape, and that the front and side view shapes of transparent vessel 2 be any appropriate shape.

Transparent vessel cavity 10 communicates with an exterior of transparent vessel 2 through transparent vessel mouth 8, which is disposed at an end of transparent vessel 2 opposite transparent vessel floor 12.

Transparent vessel wall 3 comprises transparent vessel wall inside surface 6 immediately adjacent transparent vessel cavity 10, and transparent vessel wall outside surface 4 on an exterior surface of transparent vessel wall 3.

Content 20 is depicted as being displayed within transparent vessel 2 in FIG. 1. Content 20 comprises at least one content display surface 22. Display surface 22 contains whatever information is desired to be displayed, e.g. pictures, text, designs, commercial messages, etc.

In accordance with the instant apparatus and method to display content, content 20 is emplaced within transparent vessel cavity 10 with content display surface 22 flat against transparent vessel wall inside surface 6. In this position, content display surface 22 is easily visible from an outside of transparent vessel 2 through transparent vessel wall 3. As mentioned previously, in the preferred embodiment, transparent vessel wall 3 was transparent, although it is intended to fall within the scope of this disclosure that transparent vessel wall 3 be clear, colored, translucent, or any other optical variation which permits viewing of content display surface 22 through transparent vessel wall 3.

Stabilization media 30 holds content 20 snugly against transparent vessel wall inside surface 6. Stabilization media 30 may be glass beads, marbles, sea shells, stones, sand, or any other appropriate frangible media which may be poured into transparent vessel 2 and press content 20 against transparent vessel wall inside surface 6 as depicted in FIG. 1.

The display configuration of content 20 and stabilization media 30 within transparent vessel 2 is achieved by means of the instant method, which comprises the steps of inserting rolled-up content 20 into transparent vessel cavity 10 through transparent vessel mouth 8, unrolling content 20, holding content 20 with content display side 22 flat against transparent vessel wall inside surface 6 using prod 50, and then inserting sufficient stabilization media 30 into transparent vessel cavity 10 through transparent vessel mouth 8 to securely hold content 20 in place against transparent vessel wall inside surface 6.

Figure 3:
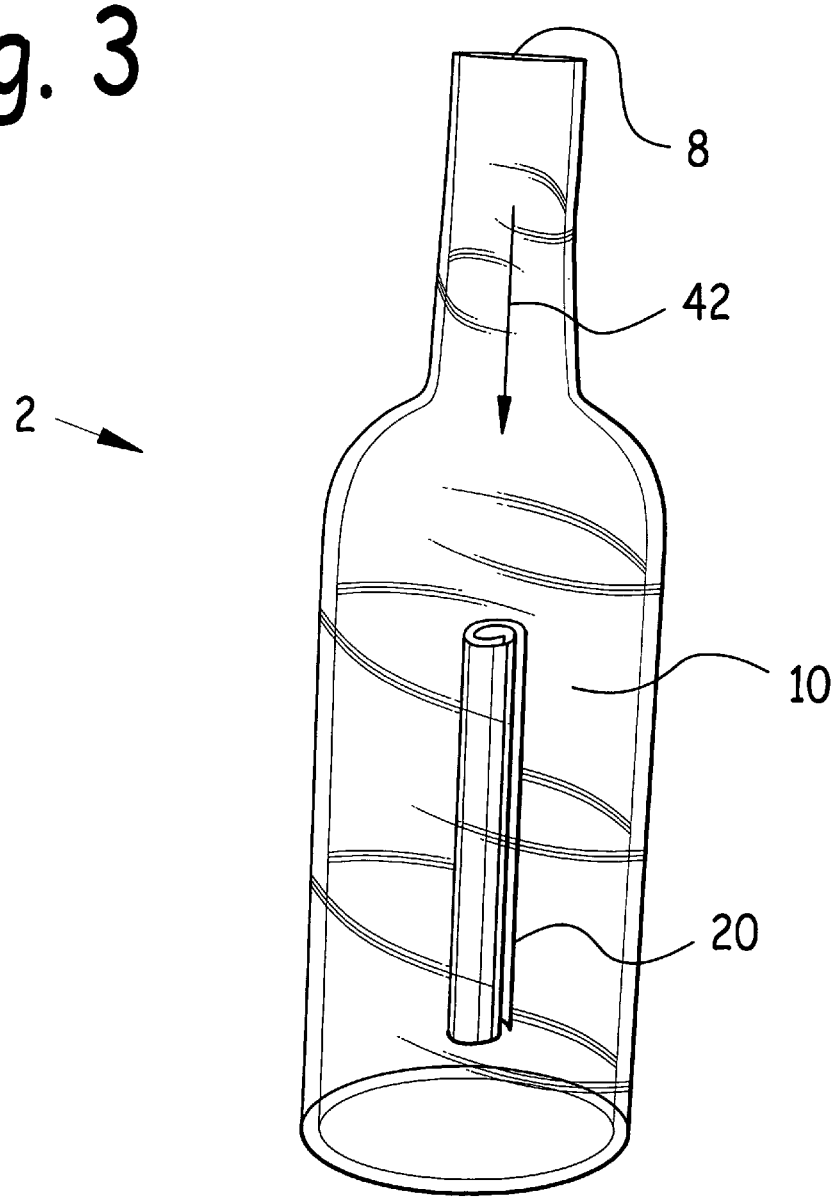
FIG. 3 is a front isometric view of a transparent vessel depicting rolled-up content which has been inserted into the transparent vessel.
Figure 6:
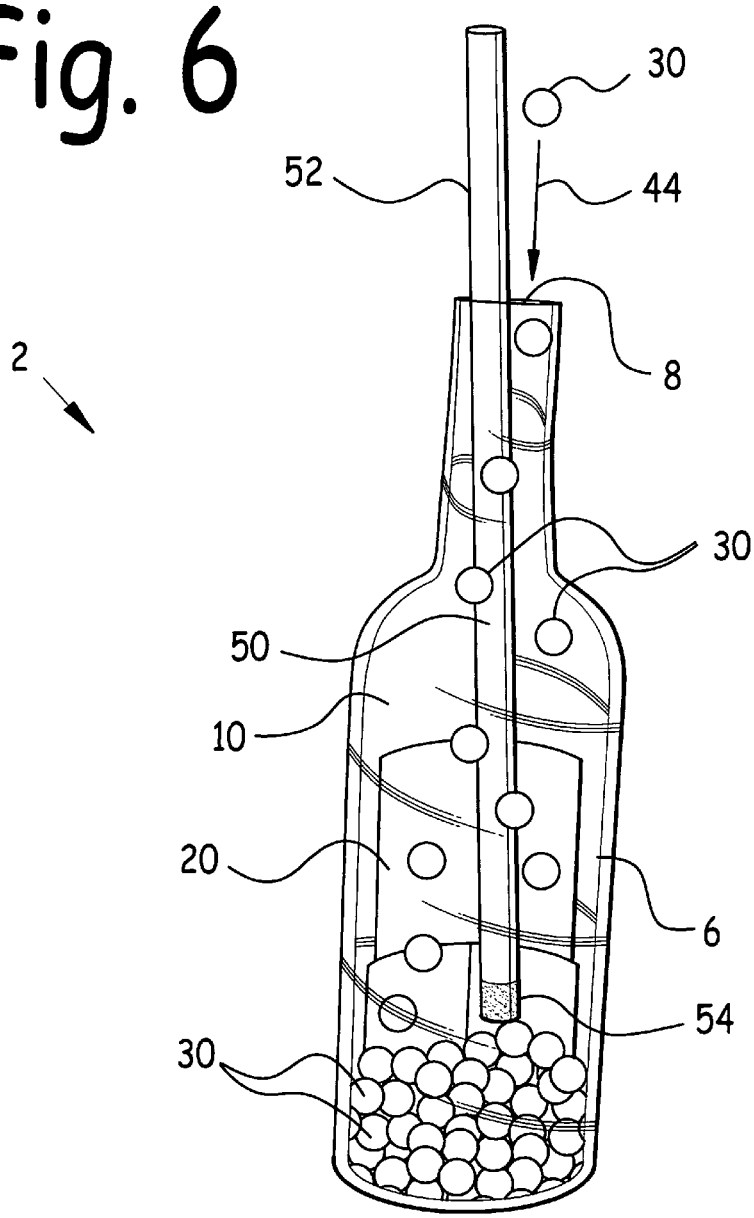
FIG. 6 is a front isometric view of a prod being used to hold unrolled content in place against a wall inside surface of a transparent vessel, and stabilizing media being inserted into the vessel to hold the content against the wall inside surface of the transparent vessel.

FIGS. 2 through 6 depict the instant method of creating the display configuration depicted in FIG. 1. FIG. 2 is a front isometric view of transparent vessel 2 and depicts rolled-up content 20 being inserted into transparent vessel 2. FIG. 3 is a front isometric view of transparent vessel 2 depicting rolled-up content 20 which has been inserted into transparent vessel 2. FIG. 4 is a front isometric view of prod 50. FIG. 5 is a front isometric view of prod 50 being used to hold unrolled content display surface 22 of content 20 in place against transparent vessel wall inside surface 6. FIG. 6 is a front isometric view of prod 50 being used to hold unrolled content display surface 22 of content 20 in place against transparent vessel wall inside surface 6, and stabilizing media 30 being inserted into transparent vessel cavity 10 to hold content display surface 22 flat against transparent vessel wall inside surface 4.

Referring now to FIGS. 2-6, first content 20 is rolled up into a diameter less than the width of transparent vessel mouth 8, so as to be able to slidably fit through transparent vessel mouth 8, with content display surface 22 facing outwards. Rolled-up content 20 is then inserted into transparent vessel cavity 10 through transparent vessel mouth 8, as indicated by arrow 40 in FIG. 2, and arrow 42 in FIG. 3.

Next content 20 is unrolled and content display surface 22 is emplaced flat against transparent vessel wall inside surface 6 in a desired display position, as depicted in FIG. 5. Prod 50 may be used to aid in the unrolling and emplacement of content 20 steps, and may then be used to hold content display surface 22 flat against transparent vessel wall inside surface 6 while enough stabilization media 30 to hold content 20 in the desired position is inserted into transparent vessel cavity 10 through transparent vessel mouth 8, as indicated by arrow 44 in FIG. 6.

As may be observed in FIG. 4, prod 50 comprises non-slip prod tip 54 disposed at one end of prod shaft 52. Prod tip 54 is made of non-slip material such as rubber, in order to help prod 50 maintain content 20 in the desired position against transparent vessel wall inside surface 6. Prod shaft 52 is long enough to afford easy grasping of the end of prod shaft 52 opposite prod tip 54, which end extends out of transparent vessel cavity 10 through transparent vessel mouth 8 when prod 50 is in use. Thus, in the preferred embodiment, the length of prod 50 was at least as great as the distance between transparent vessel floor 12 and transparent vessel mouth 8.

In use, an end of prod shaft 52 opposite prod tip 54 may be grasped, and an end of prod shaft 52 having prod tip 54 may be inserted through transparent vessel mouth 8 into transparent vessel cavity 10, and content display surface 22 may be held against transparent vessel wall inside surface 6 by pressing prod tip 54 against content 20.

Accordingly, the instant method steps to display content in a transparent vessel comprise the steps of:

A. Providing a transparent vessel having a transparent wall, transparent vessel floor, and transparent vessel mouth, the transparent vessel mouth being disposed at one end of the transparent vessel, the transparent vessel floor being disposed at an end of the transparent vessel opposite the transparent vessel mouth, the transparent vessel wall and transparent vessel floor defining and surrounding a transparent vessel cavity, the transparent vessel cavity communicating with an exterior of the transparent vessel through the transparent vessel mouth;

B. Providing content which is sufficiently flexible so as to be rolled up into a roll whose diameter is less than the width of the transparent vessel mouth, so that the rolled-up content can be slid into the transparent vessel cavity through the transparent vessel mouth, the content having a content display surface;

C. Providing frangible stabilization media, each element of which is sized to fit through the transparent vessel mouth;

D. Rolling up the content into a roll whose diameter is less than the width of the transparent vessel mouth, with the content display surface facing outwards;

E. Inserting the rolled-up content into the transparent vessel cavity through the transparent vessel mouth;

F. Unrolling the content and emplacing its content display surface flat against a transparent vessel wall inside surface in a desired position; and G. Inserting enough stabilization media into the transparent vessel cavity through the transparent vessel mouth to hold the content in the desired position.

The instant method may include the additional steps of providing a prod having a non-slip prod tip disposed at one end of a prod shaft, using the prod to emplace the content display surface in the desired position against the transparent vessel wall inside surface, and using the prod to maintain the content display surface in the desired position against the transparent vessel wall inside surface while inserting frangible stabilization media through the transparent vessel mouth and into the transparent vessel cavity.

The instant method may include the steps of removing the stabilization media and content from the transparent vessel, and thereafter repeating the above steps with different content.

Figure 7:
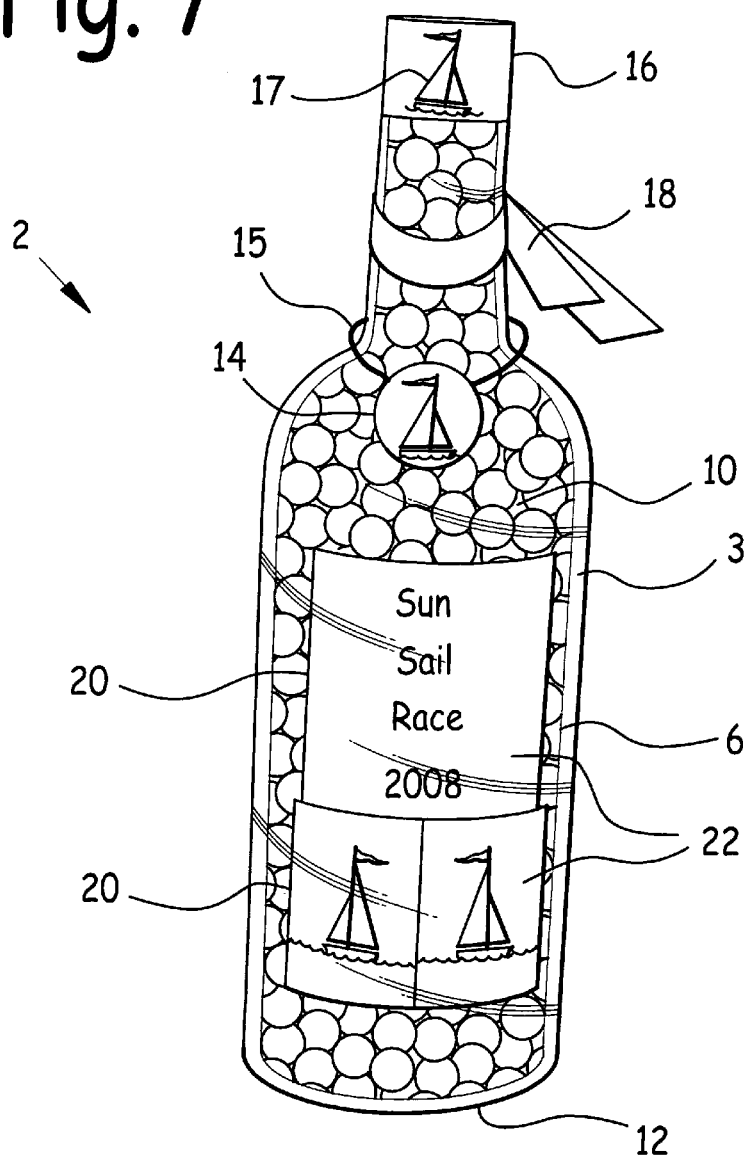
FIG. 7 is a front isometric view of content being displayed in a transparent vessel in accordance with the instant method, with a closure bearing closure indicia sealing the transparent vessel mouth, a ribbon around the transparent vessel, and an amulet chain around the transparent vessel, the amulet chain bearing an amulet.

FIG. 7 is a front isometric view of content 20 being displayed in transparent vessel 2 in accordance with the instant method. As additional steps, closure 16 may be emplaced over or into transparent vessel mouth 8 after the desired amount of stabilization media 30 has been inserted into transparent vessel cavity 10. Closure 16 may be a cap, stopper, or any other appropriate closure which serves to close off transparent vessel mouth 8 and prevent stabilization media 30 from escaping transparent vessel cavity 10 through transparent vessel mouth 8. Closure 16 may bear closure indicia 17.

Transparent vessel 2 may further comprise ribbon 18 tied around transparent vessel 2, and/or amulet chain 15 around transparent vessel 2, and amulet 14 depending from amulet chain 15.

In the preferred embodiment, transparent vessel 2 was made of glass, clear glass, translucent glass, colored translucent glass, plastic, transparent plastic, or any other appropriate material. Content 20 was picture(s), print-out(s) on paper or cardboard, text and/or pictures on paper, cardboard, or any other sheet sufficiently flexible to be rolled up into a roll having a diameter small enough to slide through transparent vessel mouth 8.

Stabilization media 30 was any media containing a plurality of elements, each of which elements were sufficiently small to slide through transparent vessel mouth 8 into transparent vessel cavity 10, including but not limited to glass beads, marbles, sea shells, stones, sand, or any other appropriate media which may be poured into transparent vessel 2 and press content 20 against transparent vessel wall inside surface 6.

Prod shaft 52 was wood, synthetic, plastic, metal, or any other appropriate rigid material. Prod tip 54 was any appropriate non-slip material, including but not limited to rubber, foam rubber, synthetic, etc.

In the preferred embodiment, content display surface 22 bore indicia such as pictures, text, etc. For example, content 20 could include inscribed on content display surface 22 the title "Time In A Bottle", text pertaining to an individual, and a series of time-sequential pictures of the individual at different points in that individual's life, e.g. kindergarten, elementary school, a middle school graduation picture, high school, etc. Other indicia on content display surface 22 could include titles such as "Bottled Memories" or "All Bottled Up", and pictures and text appropriate to the memories sought to be depicted, or any other appropriate theme.

While a preferred embodiment of the invention has been illustrated herein, it is to be understood that changes and variations may be made by those skilled in the art without departing from the spirit of the appending claims.

DRAWING ITEM INDEX

| | |
|---|---|
| 2 | transparent vessel |
| 3 | transparent vessel wall |
| 4 | transparent vessel wall outside surface |
| 6 | transparent vessel wall inside surface |
| 8 | transparent vessel mouth |
| 10 | transparent vessel cavity |
| 12 | transparent vessel floor |
| 14 | amulet |
| 15 | amulet chain |
| 16 | closure |
| 17 | closure indicia |
| 18 | ribbon |
| 20 | content |
| 22 | content display surface |
| 30 | stabilization media |
| 40 | arrow |
| 42 | arrow |
| 44 | arrow |
| 50 | prod |
| 52 | prod shaft |
| 54 | prod tip |

I claim:

1. A method to display content in a transparent vessel comprising the steps of:

A. Providing a transparent vessel having a transparent vessel wall, a transparent vessel floor, and a transparent vessel mouth, said transparent vessel mouth being disposed at one end of said transparent vessel, said transparent vessel floor being disposed at an end of said transparent vessel opposite said transparent vessel mouth, said transparent vessel wall and transparent vessel floor defining and surrounding a transparent vessel cavity, said transparent vessel cavity communicating with an exterior of said transparent vessel through said transparent vessel mouth;

B. Providing content comprising a content display surface, said content being sufficiently flexible so as to be rolled up into a roll of diameter less than a width of transparent vessel mouth, whereby the rolled-up content may be slid into said transparent vessel cavity through said transparent vessel mouth;

C. Providing stabilization media comprised of a plurality of elements, each said element being sized to fit through said transparent vessel mouth;

D. Rolling up said content into a roll whose diameter is less than the width of said transparent vessel mouth, with said content display surface facing outwards;

E. Inserting said rolled-up content into said transparent vessel cavity through said transparent vessel mouth;

F. Unrolling said content and emplacing said content display surface flat against a transparent vessel wall inside surface in a desired position;

G. Providing a prod having a non-slip prod tip disposed at one end of a prod shaft, grasping said prod shaft, inserting an end of said prod having said prod tip through said transparent vessel mouth and into said transparent vessel cavity, placing said prod non-slip tip against said content, using said prod to emplace said content display surface in said desired position against said transparent vessel wall inside surface, pressing said content display surface against said transparent vessel wall inside surface with said prod tip to maintain said content display surface in said desired position against said transparent vessel wall inside surface while inserting said stabilization media through said transparent vessel mouth and into said transparent vessel cavity, and removing said prod from said transparent vessel cavity;

H. Inserting enough said stabilization media into said transparent vessel cavity through said transparent vessel mouth to hold said content in said desired position; and I. Said stabilization media removably holding said content display surface in position against said transparent vessel wall inside surface, whereby said content display surface is visible through said transparent vessel wall to observers disposed outside said transparent vessel.

2. The method to display content in a transparent vessel of claim 1 comprising the further steps of providing a closure, sealing said transparent vessel mouth with said closure after a desired amount of said stabilization media has been inserted into transparent vessel cavity, whereby said closure may prevents escape of said stabilization media from said transparent vessel cavity.

3. The said method to display content in a transparent vessel of claim 2 comprising the further steps of providing an displaying indicia on said closure.

4. The method to display content in a transparent vessel of claim 1 comprising the further steps of providing a ribbon, and tying said ribbon around said transparent vessel.

5. The method to display content in a transparent vessel of claim 1 comprising the further steps of providing an amulet bearing indicia and an amulet chain, said amulet depending from said amulet chain, and hanging said amulet chain around said transparent vessel.

6. The method to display content in a transparent vessel of claim 1 comprising the further steps of removing said stabilization media and said content from said transparent vessel.

* * * * *